US006998790B2

(12) United States Patent
Sun

(10) Patent No.: US 6,998,790 B2
(45) Date of Patent: Feb. 14, 2006

(54) DESIGN METHODOLOGY OF POWER SUPPLY LINES IN ELECTROLUMINESCENCE DISPLAY

(75) Inventor: Wein-Town Sun, Kaohsiung (TW)

(73) Assignee: Au Optronics Corporation, Hsinchu (TW)

( * ) Notice: Subject to any disclaimer, the term of this patent is extended or adjusted under 35 U.S.C. 154(b) by 23 days.

(21) Appl. No.: 10/785,100

(22) Filed: Feb. 25, 2004

(65) Prior Publication Data

US 2005/0184673 A1 Aug. 25, 2005

(51) Int. Cl.
*G09G 3/10* (2006.01)
*G09G 2/30* (2006.01)

(52) U.S. Cl. ..... 315/169.3; 345/76

(58) Field of Classification Search ..... 315/169.3, 315/169.4; 345/76, 84, 90, 92, 105
See application file for complete search history.

(56) References Cited

U.S. PATENT DOCUMENTS

| | | | | |
|---|---|---|---|---|
| 6,380,688 | B1 | 4/2002 | Bae et al. | 315/169.3 |
| 6,661,397 | B1 * | 12/2003 | Mikami et al. | 345/76 |
| 6,870,553 | B1 * | 3/2005 | Kondo et al. | 345/690 |
| 2003/0042834 | A1 * | 3/2003 | Dean et al. | 313/309 |
| 2004/0145306 | A1 * | 7/2004 | Park et al. | 313/506 |
| 2005/0001792 | A1 * | 1/2005 | Watanabe et al. | 345/55 |

* cited by examiner

*Primary Examiner*—Wilson Lee
*Assistant Examiner*—Minh Dieu A
(74) *Attorney, Agent, or Firm*—Thomas, Kayden, Horstemeyer & Risle

(57) ABSTRACT

A current-driven display device that comprises a plurality of data lines, a plurality of scan lines formed generally orthogonal with the plurality of data lines, an array of pixels driven by a current, each of the pixels being formed near a crossing of one of the data lines and one of the scan lines, and at least one power supply line coupled to the pixels, wherein a maximum average current density at a cross section of the power supply line is no greater than approximately $10^5$ ampere per square centimeter ($A/cm^2$).

19 Claims, 4 Drawing Sheets

DESIGN METHODOLOGY OF POWER SUPPLY LINES IN ELECTROLUMINESCENCE DISPLAY

DESCRIPTION OF THE INVENTION

1. Field of the Invention

This invention relates in general to a current-driven display device and, more particularly, to an electroluminescence display ("ELD") device and a design method for avoiding electromigration effects.

2. Background of the Invention

Electric currents are generally conveyed in conductors by electrons. When a voltage is applied across a conductor stripe such as a metal line, electrons begin to flow through the metal line, and the current flow generates heat in the conductors. A phenomenon called electromigration may occur when a conductor is maintained at an elevated temperature and the current flow induces mass transport in the conductor. This current induced mass transport results from the combined effects of direct momentum exchange from mobile electrons and the influence of an applied electric field. The mass transport causes a partial removal of conductor ions from their lattice sites, leaving behind voids or vacancies, or a deposition of conductor ions, resulting in hillocks or whiskers. The voids and hillocks may respectively cause an open circuit and a short circuit in the conductor stripe, and adversely affect the performance of current-driven display devices.

Electromigration may cause other problems in semiconductor devices. For examples, a passivation layer such as a glass, silicon nitride or silicon dioxide layer formed on a semiconductor device may be subject to fracture due to removal or deposition of metal ions, resulting in the exposure of some device components to atmospheric corrosion.

The magnitude of electromigration effects typically depends on two factors, temperature and current density. Generally, at current densities below $10^4$ ampere per square centimeter ($A/cm^2$), electromigration has little effect on the life expectancy of a conductor. At current densities above $10^5$ $A/cm^2$, however, electromigration may be the principal cause of circuit deterioration. Electromigration has been known to occur in conductors such as aluminum (Al), copper (Cu), silver (Ag), gold (Au), platinum (Pt) or combinations thereof.

A test result showing the electromigration effects on an aluminum line is illustrated in FIG. 1. The aluminum line includes a first pad where a constant current (I) with a current density of $2.5\times10^5$ $A/cm^2$ is applied, and a second pad grounded. Referring to FIG. 1, after approximately 8000 seconds, the voltage across both ends of the aluminum line increases from approximately 7.9 volts to 9 volts. In view of Ohm's Rule ($V=I\times R$), since the current I is a constant, the increase in the voltage across the aluminum line results from an increase in resistance of the aluminum line, which in turn results from the electromigration effects.

One conventional technique in the art to alleviate electromigration effects in metal lines includes alloying aluminum (Al) with copper (Cu), titanium (Ti), palladium (Pd) or silicon (Si). Another technique in the art may include providing layered structures. Still another technique in the art uses multiple power supply lines to suppress excessive current, and in turn, excessive heat. However, these techniques in the art do not particularly define a design methodology for power supply lines in a current-driven display device, for example, an electroluminescence display device.

SUMMARY OF THE INVENTION

Accordingly, the present invention is directed to a device and method that obviate one or more of the problems due to limitations and disadvantages of the related art.

To achieve these and other advantages, and in accordance with the purpose of the invention as embodied and broadly described, there is provided a current-driven display device that comprises a plurality of data lines, a plurality of scan lines formed generally orthogonal with the plurality of data lines, an array of pixels driven by a current, each of the pixels being formed near a crossing of one of the data lines and one of the scan lines, and at least one power supply line coupled to the pixels, wherein a maximum average current density at a cross section of the power supply line is no greater than approximately $10^5$ ampere per square centimeter ($A/cm^2$).

In one aspect, the cross section of the power supply line further comprises a width and a thickness.

In another aspect, each of the pixels further comprises an electroluminescence device.

Also in accordance with the present invention, there is provided an electroluminescence display device that comprises an array of pixels, each of the pixels further comprising a driving and controlling circuit and an electroluminescence device, at least one first power supply, at least one first power supply line coupling the pixels to the at least one first power supply, at least one second power supply, and at least one second power supply line coupling the pixels to the at least one second power supply, wherein a maximum average current density at a cross section of each of the first or second power supply line is no greater than approximately $10^5$ ampere per square centimeter ($A/cm^2$).

In one aspect, the electroluminescence device further comprises an organic light emitting diode.

Still in accordance with the present invention, there is provided a method of suppressing electromigration effects in a power supply line for a current-driven display device that comprises the steps of providing an array of pixels, each of the pixels comprising an electroluminescence device, providing at least one first power supply line, providing at least one second power supply line, electrically coupling each of the pixels to one of the at least one first power supply line and one of the at least one second power supply line, providing a current to the pixels via the at least one first and second power supply lines, and measuring a maximum average current density at a cross section of each of the at least one first and second power supply lines at no greater than approximately $10^5$ ampere per square centimeter ($A/cm^2$).

Additional objects and advantages of the invention will be set forth in part in the description which follows, and in part will be obvious from the description, or may be learned by practice of the invention. The objects and advantages of the invention will be realized and attained by means of the elements and combinations pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present embodiment of the invention, an example of which is illustrated in the accompanying drawings. Wherever possible, the same reference numbers will be used throughout the drawings to refer to the same or like parts.

Figure 1:
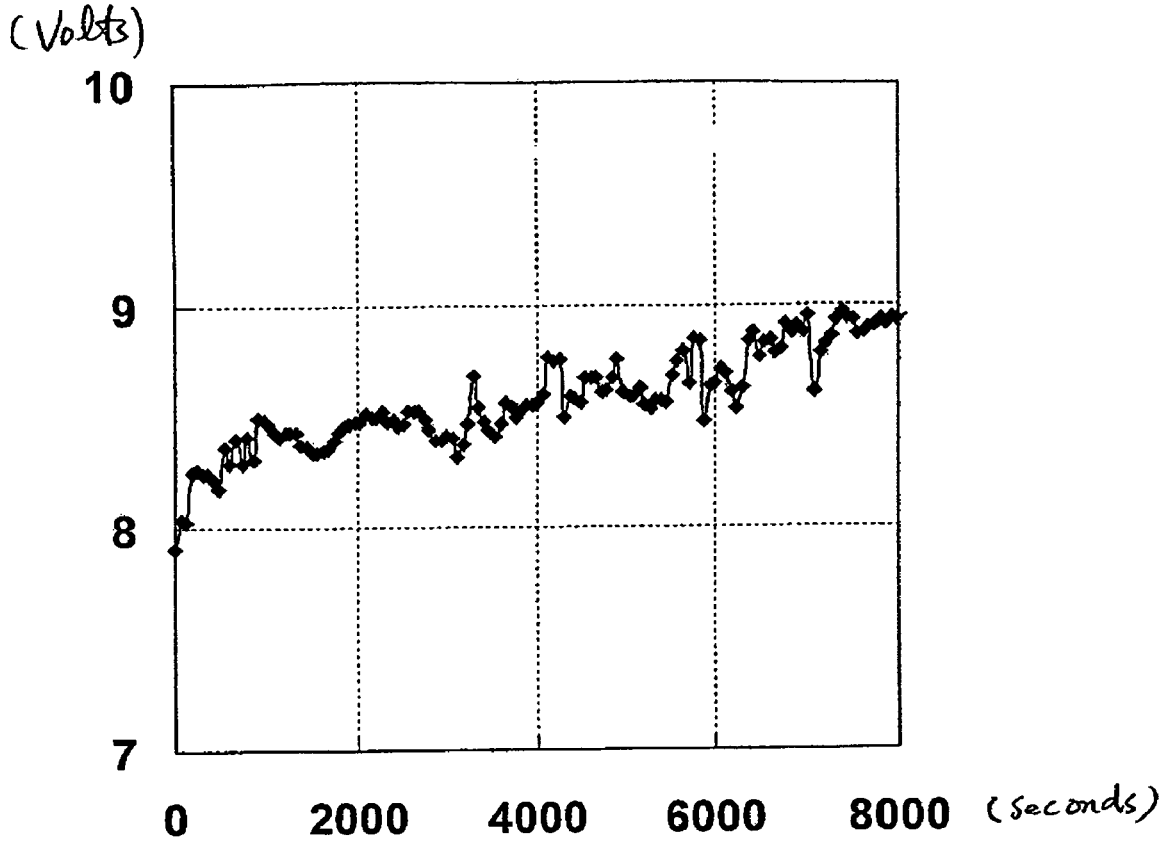
FIG. 1 is a diagram exemplarily illustrating electromigration effects in aluminum lines.
Figure 2A:
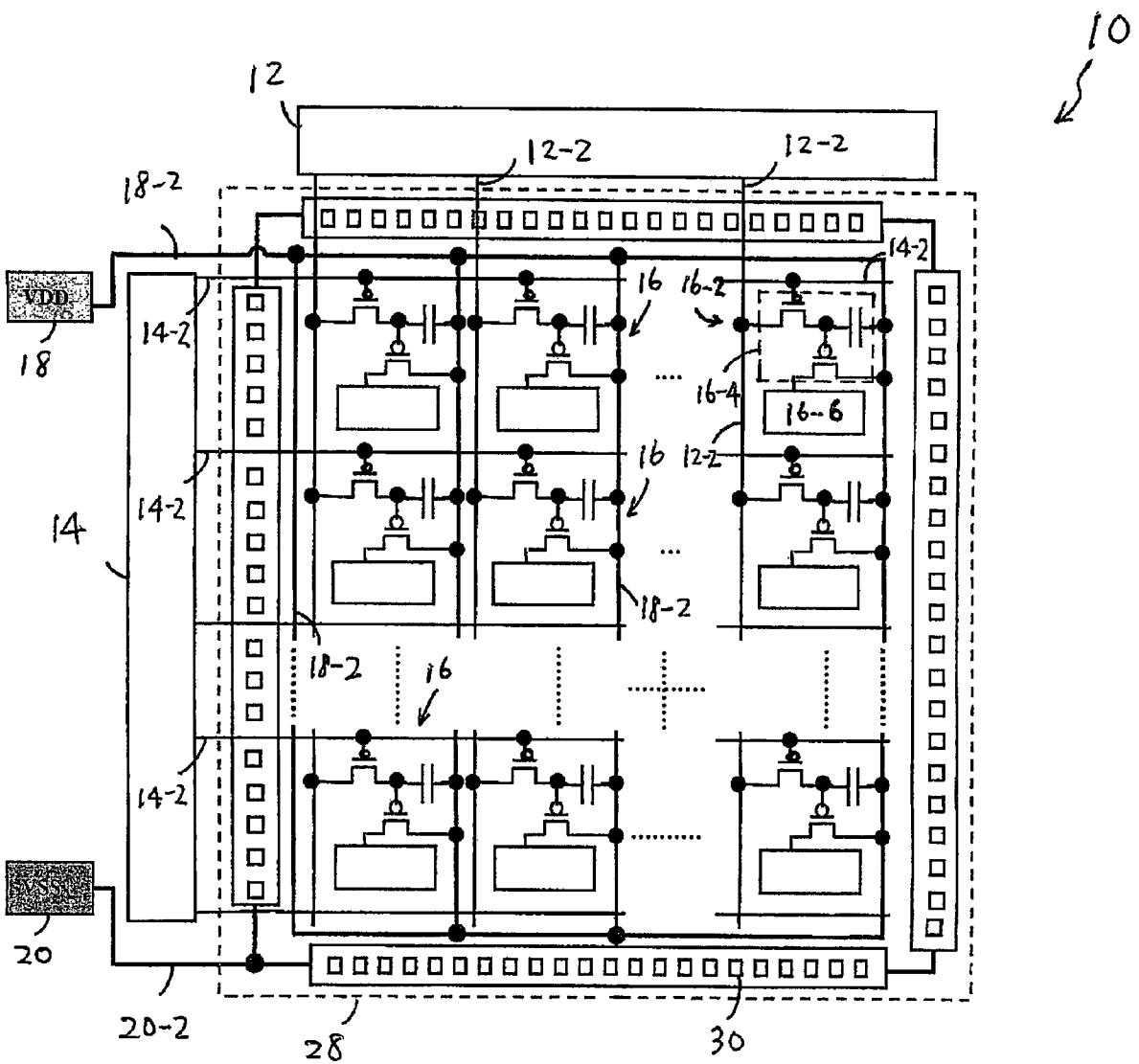
FIG. 2A is a circuit diagram of a current-driven display device in accordance with one embodiment of the present invention.

FIG. 2A is a circuit diagram of a current-driven display device 10 in accordance with one embodiment of the present invention. A current-driven display device 10 includes a data driver 12, a scan driver 14, an array of pixels 16, and at least a first power supply line 18-2 and at least a second power supply line 20-2 coupled to the array of pixels 16. First power supply line 18-2 is coupled to a first power supply, for example, VDD. Second power supply line 20-2 is coupled to a second power supply, for example, VSS. The area of a cross-section of first power supply line 18-2 or second power supply line 20-2 satisfies that a maximum average current density at the cross-section is no greater than approximately $10^5$ ampere per square centimeter ($A/cm^2$).

In one embodiment according to the invention, first power supply line 18-2 or second power supply line 20-2 in cross-section includes a width (W) and a thickness (T). When a current (I) flows through first power supply line 18-2 or second power supply line 20-2, the magnitudes of W and T ensure that a maximum average current density at the cross-section, defined as I/WT, is no greater than approximately $10^5$ $A/cm^2$. In one embodiment, the width ranges from approximately 100 micro meters to 2000 micro meters, and the thickness ranges from approximately 2000 angstroms to 6000 angstroms. First power supply line 18-2 or second power supply line 20-2 may be made of metals selected from a group consisting of aluminum (Al), copper (Cu), silver (Ag), gold (Au), platinum (Pt) or combinations thereof.

Referring again to FIG. 2A, a representative pixel 16-2 is formed near the crossing of one of a plurality of data lines 12-2 and one of a plurality of scan lines 14-2. Each data line 12-2 and each scan line 14-2, disposed substantially orthogonal to each other, are coupled to data driver 12 and scan driver 14, respectively. Representative pixel 16-2 includes a driving and controlling circuit 16-4 and an electroluminescence device 16-6, described in further detail herein.

Figure 2C:
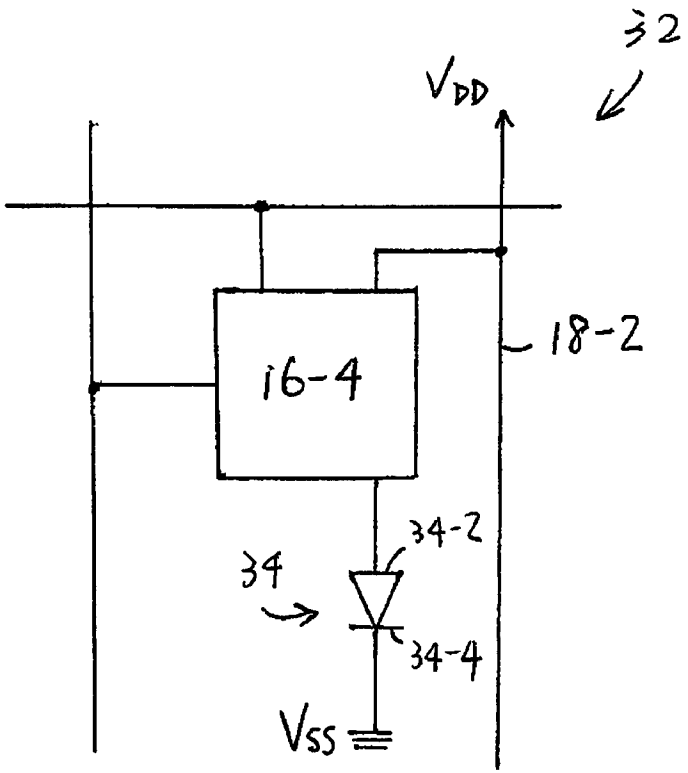
FIG. 2C is a circuit diagram of a pixel of a current-driven display device in accordance with one embodiment of the present invention.
Figure 2B:
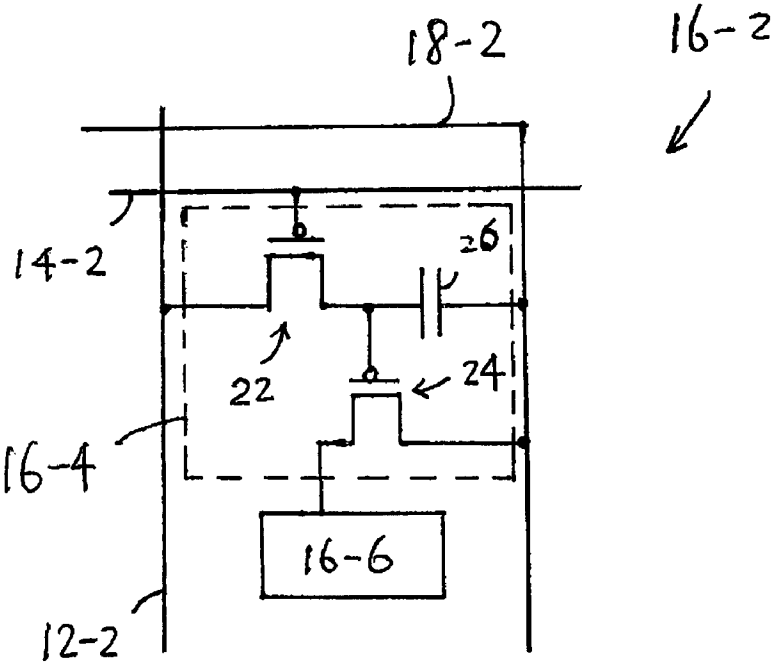
FIG. 2B is an enlarged circuit diagram of a pixel of the current-driven display device shown in FIG. 2A.

FIG. 2B is an enlarged circuit diagram of representative pixel 16-2 of current-driven display device 10 shown in FIG. 2A. In one embodiment, driving and controlling circuit 16-4 of representative pixel 16-2 includes a switching transistor 22, a driving transistor 24, and a storage capacitor 26. Switching transistor 22 includes a gate (not numbered) coupled to scan line 14-2, a source (not numbered) coupled to data line 12-2, and a drain (not numbered) coupled to one terminal (not numbered) of storage capacitor 26. Driving transistor 24 includes a gate (not numbered) coupled to the one terminal of storage capacitor 26, a source (not numbered) coupled to first power supply line 18-2, and a drain (not numbered) coupled to electroluminescence device 16-6. The other terminal (not numbered) of storage capacitor 26 is coupled to first power supply line 18-2.

In operation, referring to FIG. 2A, scan driver 14 activates one of scan lines 14-2 to select a corresponding row of pixels 16 by turning on switching transistors 22 associated with the one scan line 14-2. Data driver 12 then activates at least one of data lines 12-2 to store data in capacitors 26 by turning on driving transistors 24.

Electroluminescence device 16-6 includes a first terminal (not numbered) coupled to first power supply line 18-2 via driving and controlling circuit 16-4. Second terminals of electroluminescence devices 16-6 are connected together to form a common electrode 28, and coupled to second power supply line 20-2 via contact holes 30. In one embodiment according to the invention, electroluminescence device 16-6 includes an electroluminescence layer comprising an organic electroluminescence material. FIG. 2C is a circuit diagram of a pixel 32 including an organic light emitting diode ("OLED") 34 to serve as an electroluminescence device. Referring to FIG. 2C, OLED 34 includes an anode 34-2 coupled to VDD via driving and controlling circuit 16-4 and first power supply line 18-2, and a cathode 34-4 coupled to VSS.

Figure 3:
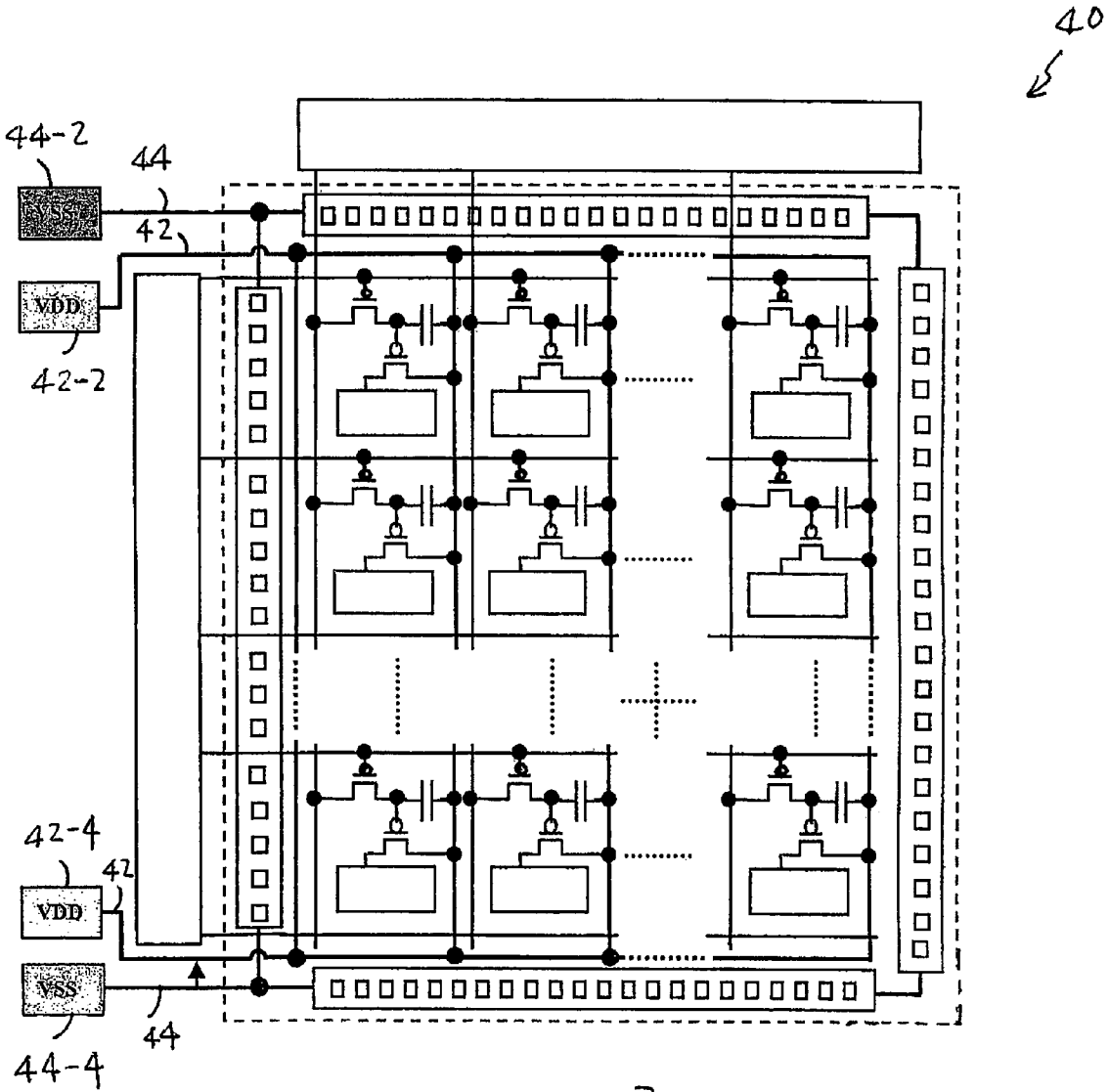
FIG. 3 is a circuit diagram of a current-driven display device in accordance with another embodiment of the present invention.

FIG. 3 is a circuit diagram of a current-driven display device 40 in accordance with another embodiment of the present invention. Referring to FIG. 3, current-driven display device 40 has a similar circuit structure to that of current-driven display device 10 shown in FIG. 2A, except the number of power supplies. Current-driven display device 40 includes first power supplies 42-2 and 42-4, for example, VDD, and second power supplies 44-2 and 44-4, for example, VSS. First power supply line 42 associated with first power supplies 42-2 and 42-4, or second power supply line 44 associated with second power supplies 44-2 and 44-4 (in the respective cross section) will ensure that a maximum average current density at the cross-section is no greater than approximately $10^5$ ampere per square centimeter ($A/cm^2$).

The present invention also provides a method of suppressing electromigration effects in a power supply line for a current-driven display device. An array of pixels 16 is provided, in which each of pixels 16 includes an electroluminescence device 16-6. At least one first power supply line 18-2, and at least one second power supply line 20-2 are provided. Each of pixels 16 is electrically coupled to one of the at least one first power supply line 18-2 and one of the at least one second power supply line 20-2. A current is then provided to pixels 16 via the at least one first power supply line 18-2 and the at least one second power supply line 20-2. A maximum average current density at a cross-section of each of the at least one first power supply line 18-2 and the at least one second power supply line 20-2 is measured at no greater than approximately $10^5$ ampere per square centimeter ($A/cm^2$).

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A current-driven display device comprising: a plurality of data lines;

a plurality of scan lines formed generally orthogonal with the plurality of data lines;

an array of pixels driven by a current, each of the pixels being formed near a crossing of one of the data lines and one of the scan lines; and at least one power supply line coupled to the pixels, wherein a maximum average current density at a cross section of the power supply line is no greater than approximately $10^5$ ampere per square centimeter ($A/cm^2$).

2. The device of claim 1, the cross section of the power supply line further comprising a width and a thickness.

3. The device of claim 2 wherein the width ranges from approximately 100 micro meters to 2000 micro meters.

4. The device of claim 2 wherein the thickness ranges from approximately 2000 angstroms to 6000 angstroms.

5. The device of claim 1, each of the pixels further comprising an electroluminescence device.

6. The device of claim 5, the electroluminescence device further comprising an anode, a cathode, and an electroluminescence layer formed between the anode and the cathode.

7. The device of claim 6, the electroluminescence layer further comprising an organic electroluminescence material.

8. The device of claim 6, the anode of the electroluminescence device being coupled to a first power supply line via a driving and controlling circuit.

9. The device of claim 6, the cathode of the electroluminescence device being coupled to a second power supply line.

10. An electroluminescence display device comprising:

an array of pixels, each of the pixels further comprising a driving and controlling circuit and an electroluminescence device;

at least one first power supply;

at least one first power supply line coupling the pixels to the at least one first power supply;

at least one second power supply; and at least one second power supply line coupling the pixels to the at least one second power supply, wherein a maximum average current density at a cross section of each of the first or second power supply line is no greater than approximately $10^5$ ampere per square centimeter ($A/cm^2$).

11. The device of claim 10, the cross-section of each of the first or second the power supply line further comprising a width and a thickness.

12. The device of claim 10, the electroluminescence device further comprising an anode, a cathode, and an electroluminescence layer formed between the anode and the cathode.

13. The device of claim 12, the electroluminescence layer further comprising an organic electroluminescence material.

14. The device of claim 12, the anode of the electroluminescence device being coupled to one of the at least one first power supply line via the driving and controlling circuit.

15. The device of claim 12, the cathode of the electroluminescence device being coupled to one of the at least one second power supply line via a contact hole.

16. The device of claim 10, the electroluminescence device further comprising an organic light emitting diode.

17. A method of suppressing electromigration effects in a power supply line for a current-driven display device comprising the steps of:

providing an array of pixels, each of the pixels comprising an electroluminescence device;

providing at least one first power supply line;

providing at least one second power supply line;

electrically coupling each of the pixels to one of the at least one first power supply line and one of the at least one second power supply line;

providing a current to the pixels via the at least one first and second power supply lines; and measuring a maximum average current density at a cross section of each of the at least one first and second power supply lines at no greater than approximately $10^5$ ampere per square centimeter ($A/cm^2$).

18. The method of claim 17 further comprising the step of forming the electroluminescence device with an anode, a cathode, and an electroluminescence layer formed between the anode and the cathode.

19. The method of claim 18 further comprising the step of forming the electroluminescence layer with an organic electroluminescence material.

* * * * *